US009371171B1

(12) United States Patent
Babcock

(10) Patent No.: US 9,371,171 B1
(45) Date of Patent: Jun. 21, 2016

(54) NON-REEL DISPENSING CARTON

(71) Applicant: Kenneth R. Babcock, Long Beach, CA (US)

(72) Inventor: Kenneth R. Babcock, Long Beach, CA (US)

( * ) Notice: Subject to any disclaimer, the term of this patent is extended or adjusted under 35 U.S.C. 154(b) by 402 days.

(21) Appl. No.: 13/828,991

(22) Filed: Mar. 14, 2013

Related U.S. Application Data

(63) Continuation-in-part of application No. 11/675,755, filed on Feb. 16, 2007, now Pat. No. 8,596,455, and a continuation-in-part of application No. 11/375,727, filed on Mar. 15, 2006, now Pat. No. 8,006,840, and a continuation-in-part of application No. 12/635,184, filed on Dec. 10, 2009, now Pat. No. 8,596,518.

(60) Provisional application No. 60/722,643, filed on Sep. 30, 2005.

(51) Int. Cl.

| | |
|---|---|
| ***B65D 5/468*** | (2006.01) |
| ***B65D 85/04*** | (2006.01) |
| ***B65D 5/72*** | (2006.01) |
| ***B65H 55/04*** | (2006.01) |

(52) U.S. Cl.
CPC ..... *B65D 85/04* (2013.01); *B65D 5/4608* (2013.01); *B65D 5/725* (2013.01); *B65H 55/046* (2013.01)

(58) Field of Classification Search
CPC ..... B65H 55/046; Y10T 29/49826; B65D 5/443; B65D 5/445; B65D 5/4608
USPC ..... 242/588, 588.5, 588.6; 206/395, 397, 206/408, 409, 806, 389, 493, 526, 388; 211/44, 78, 164, 85.5; 248/200, 213.2, 248/300, 316.8, 905; 229/117.13, 117.16, 229/117.17, 163, 199
See application file for complete search history.

(56) References Cited

U.S. PATENT DOCUMENTS

| | | | | |
|---|---|---|---|---|
| 4,771,889 A * | 9/1988 | Bauer | B65D 85/671 | 206/390 |
| 8,006,840 B2 * | 8/2011 | Babcock | B65H 55/046 | 206/395 |
| 8,596,518 B2 * | 12/2013 | Babcock | B65D 5/443 | 229/117.16 |

* cited by examiner

*Primary Examiner* — William A Rivera
(74) *Attorney, Agent, or Firm* — Cook Alex Ltd.

(57) ABSTRACT

A carton has a series of panels including top and bottom panels, side panels, and front and rear panels which collectively define an interior space for carrying wire or other filamentary material. The carton is formed from a unitary blank. The cartons can be set up by an automated machine without intervention of an operator. The carton include an interior channel located between two, aligned exterior holes located in opposing panels of the carton. The interior channel is formed from several hingedly connected panels, at least one of which is attached to the carton. The hingedly connected panels are folded around or rolled to form the interior channel, which is inserted into the carton. Once assembled a shaft or rod may be passed through one of the exterior holes, through the interior channel, and out the other exterior hole. The interior channel reinforces the structure of the carton and further allows the carton to hang from a shaft or rod without the carton tearing.

9 Claims, 11 Drawing Sheets

NON-REEL DISPENSING CARTON

CROSS-REFERENCE TO RELATED APPLICATIONS

This application is a continuation-in-part of U.S. application Ser. No. 11/675,755, filed Feb. 16, 2007, which is a continuation-in-part of U.S. application Ser. No. 11/375,727, filed Mar. 15, 2006, now U.S. Pat. No. 8,006,840, which claims the benefit of U.S. Provisional Application Ser. No. 60/722,643, filed Sep. 30, 2005, and is a continuation-in-part of U.S. application Ser. No. 12/635,184, filed Dec. 10, 2009, all of which are hereby incorporated by reference.

BACKGROUND OF THE INVENTION

Filamentary materials such as wires, cables and the like are typically available to electricians or technicians in two forms, on reels or within non-reel cartons. The use of reels for the storage, transportation and dispensing of wire or cable is well known in the art. Presently, when electricians wish to dispense wire via a reel, they might attach the reel to a horizontal shaft of a pulling rack. For example, see U.S. Pat. No. 7,124,980. An electrician would then be able to pull the wire or cable tangentially off the reel.

However, as an electrician pulls the wire, the entire reel rotates and develops momentum. As a result, when the electrician stops pulling, the reel will continue to spin and release wire. The extra wire will often tangle or kink, requiring the electrician to untangle the wire and recoil the excess back on to the reel. Another problem with reel packages is disposal of the empty reel after all the wire has been removed.

Non-reel cartons eliminate the need for a reel and the attendant problem of recoiling. These cartons are sometimes also referred to as speed out cartons. Non-reel cartons utilize either conventional cardboard cartons or specialized cartons with dispensing guides. A single strand, or a multiconductor cable, of material is coiled with an open center ("air core") and then placed into the carton. The strand is then dispensed through an opening in a wall of the carton. The coil is unwound from the center or innermost strand without rotating the entire coil. See Wise U.S. Pat. No. 4,019,636 (which is incorporated herein by reference).

While non-reel cartons eliminate the unraveling and recoiling problems associated with reels, these cartons have their own problems. For example, when a coil is unwound from the center of a carton placed on the floor, resistance to uncoiling can develop that causes the entire carton to slide in the direction of dispensing. This is especially true when the wire is required to make sharp bends as it feeds through a payout tube in the side of the carton. Any tangling of the wire within the carton exacerbates this problem.

Another problem with non-reel cartons has more to do with common industry practice than with the carton itself. Many electricians prefer to use a portable wire pulling rack on which they can mount several different sizes, types and colors of wire. This provides ready access to whatever type of wire is needed for a particular job. The pulling racks typically have one or more shafts on which are mounted reel type wire packages. Non-reel cartons have no structure that enables them to be mounted on such a rack. If a hole is punched by the electrician in the non-reel carton to admit the shaft, there is a risk that doing so will damage the contents of the carton. Further, even if a shaft hole is successfully formed in the carton, the carton is not strong enough to support the weight of a full coil of wire on a shaft. Pulling forces would further degrade such a jury-rigged carton.

Another problem with existing non-reel cartons is the tendency of the cartons to tear at hand-hole openings. Such openings are provided to make it easy to grasp the carton and carry it. Often users will attempt to use one hand only to lift and carry the carton by the hand-hole opening. Depending on the contents of the carton, this can cause the carton to fail in the area surrounding the opening. The hand-hole then becomes useless and the carton must thereafter be lifted from the bottom, usually using two hands. Hand-hole failure can be a particular problem if the carton has been allowed to become damp or wet. Accordingly, non-reel cartons have been improved to overcome these shortcomings by providing an adapter for non-reel cartons that allows such cartons to be used on a wire pulling rack. Improved non-reel cartons as just described are set forth in U.S. Patent Publication No. US-2007-0215502-A1, published Sep. 20, 2007, and U.S. patent application Ser. No. 12/635,184, filed Dec. 10, 2009, the disclosures of both of which are incorporated herein by reference.

As mentioned above, one of the challenges of a non-reel carton is providing a way to mount it on a shaft of a wire dispensing cart or rack. The above-referenced patent applications address this issue by providing a carton with a reinforcing adapter. The adapter reinforces those portions of the carton which engage the shaft, thereby allowing the carton to support the weight of a full coil of wire while mounted on a shaft of a wire dispensing cart or rack. The adapter also reinforces handhold openings formed in the carton. In addition to reinforcing the carton, the adapter provides an interior, separating wall or partition that isolates the coil-receiving cavity of the carton from the shaft-receiving channel or sleeve where a shaft may protrude through the carton. While the adapter and carton may be formed from a common blank of sheet material (such as corrugated paperboard or the like), setting up the carton and installing the adapter requires separation of the adapter blank from the carton blank. The adapter and carton are then separately set up, after which the adapter is installed in the carton. For most applications this arrangement is perfectly adequate.

However, the rack-mountable, non-reel cartons shown in U.S. Patent Publication No. US-2007-0215502-A1 and U.S. patent application Ser. No. 12/635,184 are not optimized for use in a fully automated environment such as those utilizing a D-2000 machine available from Reelex Packaging Solutions, Inc. of Patterson, N.Y. A machine of this type is shown in U.S. Pat. No. 6,766,627, the disclosure of which is incorporated herein by reference. In such an environment it is desired to use a single machine to both wind the wire coils and package them in a carton, ready for shipment, with no intervention on the part of an operator.

Prior cartons that are capable of automated setup, such as that shown in U.S. Pat. No. 6,766,627, are unable to be used with a wire dispensing rack or cart. Thus, obtaining the benefits of fully automated packaging have come at the expense of producing a less capable carton.

SUMMARY

The present disclosure concerns cartons for carrying or packaging wire, cable or other filamentary material. The cartons have a series of panels including top and bottom panels, side panels, mid panels, and front and rear panels. The panels each have interior and exterior surfaces and collectively they define an interior space or cavity which receives the filamentary material.

Several panels reinforce the structure of the carton. These panels are arranged in such a way that when the carton is constructed from the blank, the panels provide additional support. Moreover, the carton is formed from a unitary blank. No additional pieces need be removed from the blank or assembled separately from the carton. These panels reinforce the top and bottom or the sides of the carton. They wrap around the outer, middle and internal panels of the carton, and secure in place using tabs. Layered panels also reinforce the hand-holds located.

The cartons may include one or more flaps stemming from one panel that overlay another panel. Adhesive applied to the underside of the flaps secures the flaps to the overlaid panel, thus stabilizing and reinforcing the shape of the carton. Layered flaps may also reinforce the hand-holds. The cartons can be set up by an automated machine without intervention of an operator.

Another embodiment includes an interior channel located between two, aligned exterior holes located in opposing panels of the carton. The interior channel is formed from several hingedly connected panels, at least one of said panels being hingedly attached to the carton. The hingedly connected panels are folded around or rolled to form the interior channel, which is inserted into the carton.

Once assembled a shaft or rod may be passed through one of the exterior holes, through the interior channel, and out the other exterior hole. The interior channel reinforces the structure of the carton and further allows the carton to hang from a shaft or rod without the carton tearing. When the carton is assembled, at least one panel of the hingedly connected panels that form the channel resides against the top panel, reinforcing the top panel.

DETAILED DESCRIPTION

Figure 1:
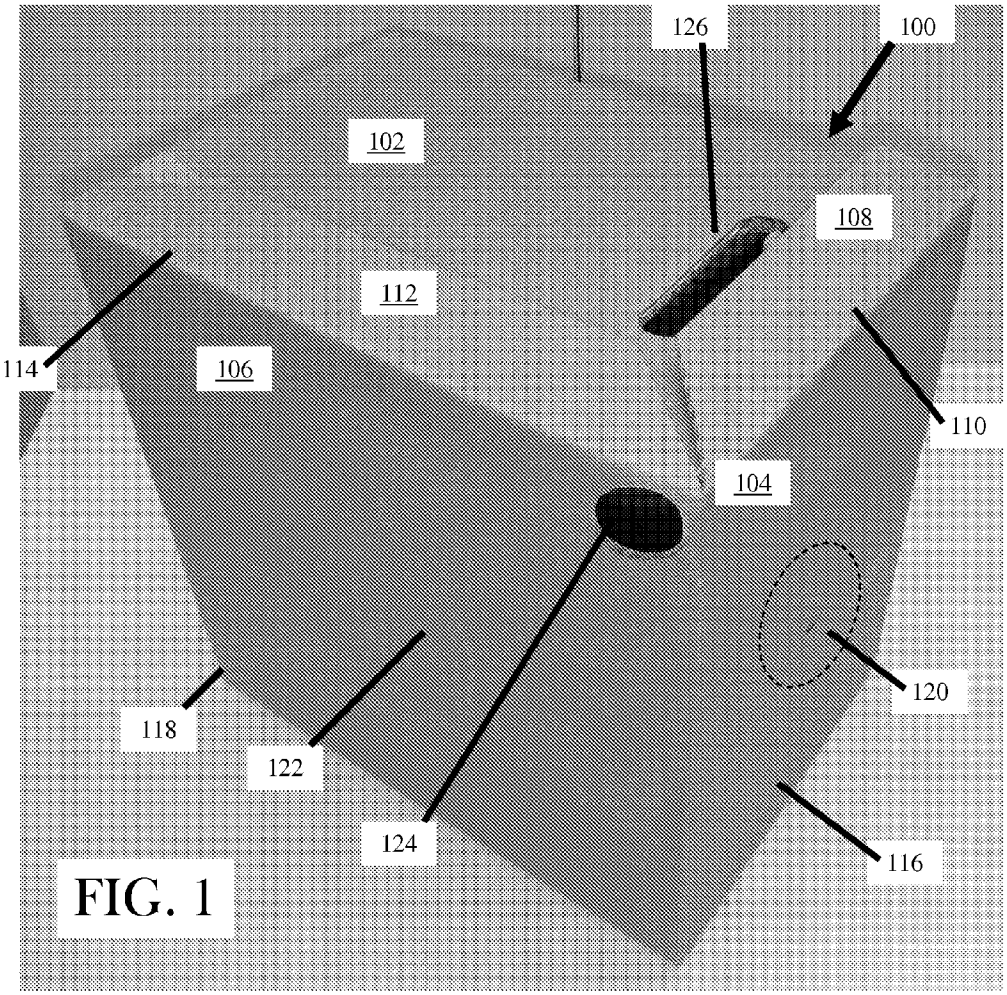
FIG. 1 is a perspective view of a first embodiment of an assembled non-reel wire carton.

The present disclosure in-part concerns non-reel wire cartons that can be set up on a fully automated machine, such as the D-2000 machine available from Reelex Packaging Solutions, Inc. of Patterson, N.Y. A machine of this type is shown in U.S. Pat. No. 6,766,627, the disclosure of which is incorporated herein by reference. FIG. 1 illustrates one embodiment of such a non-reel wire carton, generally at 100, which is disclosed herein.

An assembled non-reel carton 100 is shown in FIG. 1. The non-reel wire carton 100 has a top 102, a front 104, and left side panel 106. A first upper flap 108 is hingedly attach to and extends from the upper edge 110 of front panel 104. The first upper flap 108 folds over the top panel 102 at the hinged edge 110. The underside of flap 108 is adhered to the surface of the top panel 102. A second upper flap 112 is hingedly attached to and extends from the upper edge 114 of the left panel. The second upper flap 112 folds over the top panel 102 at the hinged edge 114. The underside of the second flap 112 is adhered to the surface of the top panel 102. Likewise, additional flaps (not shown) extend from the lower edge 116 of the front panel and the lower edge of the left side panel 118. These additional lower flaps fold over the bottom panel (not shown) and are adhered. The first and second upper flaps 108 and 112 and those not shown may be fastened by any adhesive means, such as by glue, or by any mechanical means, such as metal staples. Once the flaps are fastened, the non-reel carton 100 is closed. When used, the wire material within the carton is pulled out through an opening 120 in the front panel 104.

The left panel 106 has access door 122 to the interior non-reel wire carton 100. The access door 122 is in the shape a half circle, the circumference of which is perforated. To open the access door 122, the perforations around the circumference are broken and the door is folded back along its diameter. The door permits one to access or view the contents of the non-reel carton 100.

The non-reel wire carton 100 includes oval-shaped hole 124 in the upper corner of the left panel 106. A matching oval shaped hole is also located in the upper corner of the right panel (not shown). The oval-shaped hole 124 is located along the perimeter of the side panels in the upper corner closest to the front panel 104. In other embodiments, the oval shaped holes may be located in other corners or have other shapes, including being diamond shaped, circular, rectangular, etc. The oval hole 124 and its counterpart in the opposite panel are tilted, such that the major axis (or the longer axis of any other shape) of the oval hole 124 is roughly at a 45 degree angle to the top edge. In this embodiment, the hole is arranged such that the major axis of the oval hole 124 bisects the 90 degree angle formed by the corner of the panel.

The oval holes 124 are designed and located so as to receive a shaft or rod. The location in the upper corner permits a shaft or rod to pass entirely through the non-reel carton 100 without interfering with a coil of non-reel wire stored within. The non-reel carton 100 may then hang from the shaft or rod. As a result, the wire contained within may be pulled from the carton freely, without snagging on or being tangled by the rod or shaft.

When the non-reel wire carton 100 shown in FIG. 1 is hung from a shaft, it generally hangs at a 45 degree angle, with the front panel 104 pointed upwards. This permits the wire to be easily pulled from the non-reel carton 100 in the forward direction, parallel to the floor, and in the upward direction, perpendicular to the floor.

To prevent the non-reel carton 100 from tearing when hung on a shaft, the non-reel carton 100 includes several reinforcing layers. These layers include the top panel 102, flaps 108 and 112, and an interior top panel (not shown).

An opening 126 for a handhold is located in the top panel 102. The handhold has an oblong oval shape. When manufactured, the handhold opening 126 is created by scoring the edge closest to the front panel 104 and perforating three sides of the oblong shape, resulting in an interior cutout. To use the handhold opening 126, the perforations are broken and the interior of the oblong shape is pushed within the carton, through the interior top panel, and folded inward along the scoring. The handhold opening 126 shown in FIG. 1 is shown without the perforated interior cutout. The handhold opening 126 is reinforced by the flap 108, top panel 102 and the interior top panel (not shown).

Figure 2:
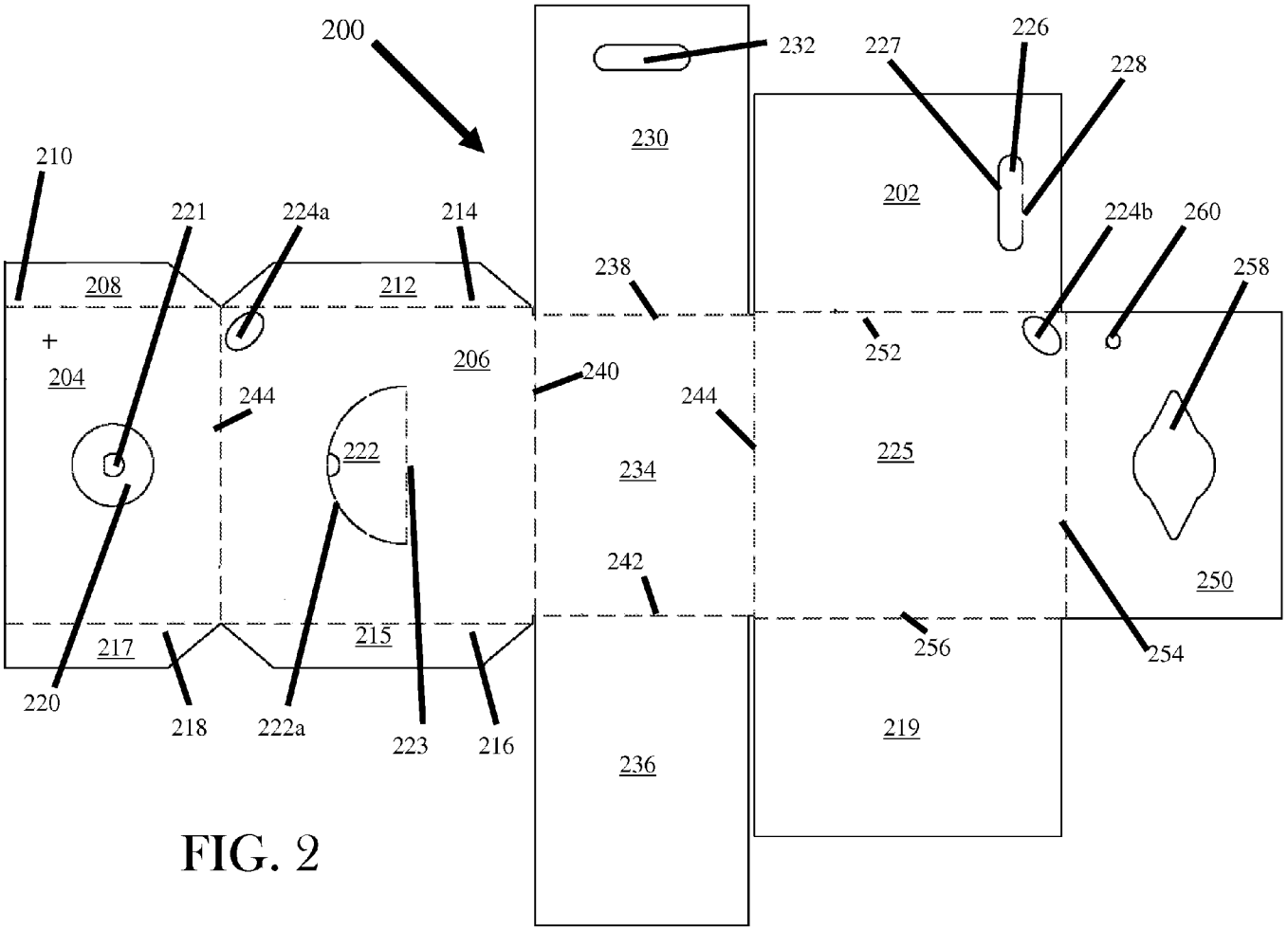
FIG. 2 is a plan view of a carton blank, illustrating a second embodiment largely similar to the first embodiment but with the oval-shaped holes angled differently.

FIG. 2 illustrates an embodiment of a blank 200 for forming a non-reel carton to hold the filamentary material, such as the one shown in FIG. 1. The blank 200 comprises a plurality of panels or walls forming an enclosed non-reel carton. Generally, the panels or walls are substantially rectangular in shape. The panels are hingedly connected to each other. If the carton blank is made from cardboard, the hinges are created by scoring or compressing the boundary between the panels.

The blank includes a top panel 202, a front panel 204, and left side panel 206. These parts correspond to the top panel 102, front panel 104, and left side panel 106, respectively. The blank 200 also includes first and second upper flaps 208 and 212, respectively, shown in FIG. 1 as first and second flaps 108 and 112. The first upper flap 208 is hingedly attached the front panel 204 at the fold line 210. The second upper flap 212 is hingedly attached the left side panel 206 at the fold line 214.

The non reel carton blank 200 includes lower flaps 215 and 217, extending from the front panel 204 and 206 at the lower fold lines 216 and 218, respectively. The first lower flap 215 is hingedly attached the left side panel 206 at the fold line 216. The second lower flap 217 is hingedly attached the front panel 206 at the fold line 218. When the non-reel carton is constructed from the blank 200, lower flaps 215 and 217 fold over the bottom panel 219 and are adhered.

The front panel 204 of the blank 200 has a perforated ring-shaped section 220 for an opening. The exterior and interior edges of the ringed-shaped section 220 are perforated. The perforation of the interior edges, which forms a center circle 221, allowing a person to first poke out the center circle 221 of the ring-shaped section 220 with their finger and then pull from the front panel 204 the rest of the ring-shaped section 220, thus gaining access to the contents of the carton.

A person may also view the contents or reach into the carton by utilizing the access door 222 located on the left side panel 206. The access door has a semi-circle shape. The semi-circle edge 222*a* of access door 222 is perforated. The access door has a fold line 223 located along the diameter of the access door. To access the contents of the non-reel carton assembled from the blank 200 (for example, as shown in FIG. 1) a person need only break the perforations along the edge 222*a* and fold the access door 222 along fold line 223.

As shown in FIG. 2, the left door panel 206 also includes oval-shaped hole 224*a* located in the upper corner. A corresponding oval-shaped hole 224*b* is located in the upper corner of the right side panel 225. These holes are cut out of the material forming the carton blank 200. In alternate embodiments the edges of the holes may be perforated, allowing a person to remove the perforated material and create the holes 244*a* and 244*b*. The oval-shaped holes 224*a* and 224*b* may be located along the perimeter of the left panel 202 or right panel 225, respectively. The position of hole 224*a* on the left side panel 202 mirrors the position of hole 224*b* on the right side panel 225.

In the embodiment shown in FIG. 2, the oval-shaped holes 224*a* and 224*b* are positioned such that minor axes of the oval-shaped holes 224*a* and 224*b* would bisect the angle formed by the upper corner of the panel 206 or 225. In alternative embodiments, such as the embodiment shown in FIG. 1, the holes are rotated such that the major axes of the oval-shaped holes would bisect the angle formed by the upper corner of the either the left or right panel.

In alternative embodiments, oval-shaped holes 224*a* and 224*b* may be located in any corner, along the perimeter of the panels, so long as the location of hole 224*a* on the left panel 206 mirrors the position of hole 224*b* on the right panel 225, such that when a non-reel carton is assembled from the blank 200, holes 224*a* and 224*b* are in substantial alignment, such that a shaft may pass through holes 224*a* and 224*b* and that the carton may hang from the shaft. As shown in FIG. 2, the holes 224*a* and 224*b* are oval-shaped; although, in alternative embodiments, the holes may consist of other shapes, such as circles, diamonds, rectangles, etc.

Additionally, the carton blank 200 also has a handhold 226 which is located in the top panel 202. The handhold 226 has an elongated oval-shaped and is formed by a perforated edge 227 along roughly three-quarters of its perimeter and a fold line 228 located along the remaining edge of its perimeter. The carton blank includes an interior upper panel 230. A handhold cutout 232 is located in the interior upper panel 230. When the blank is assembled the interior upper panel 230 is folded in before, and is then overlapped by, the top panel 202. The handhold cutout 232 is generally the same size and shape as the handhold 226. When assembled the opening of the handhold cutout 232 substantially aligns with the handhold 226. To use the handhold 226, a person breaks the perforations and folds the material outlined by the perforations along fold line 228 inward, through the handhold cutout 232, toward the center of the constructed carton. At this point, the folded material, the top panel 202, and the interior upper panel all overlap, thus, reinforcing the handhold and allowing a person to lift and carry the assembled carton.

The carton blank includes a back panel 234, which is hingedly attached or connected to the interior upper panel 230, left side panel 206, interior lower panel 236 and right side panel 225, by fold lines or score lines 238, 240, 242, and 244, respectively. The right panel 225 is hingedly attached to the top panel 202, interior front panel 250, and bottom panel 219, by fold lines or score lines, 252, 254, and 256, respectively.

The interior front panel 250 also includes a payout tube hole 258 and a filamentary material retention hole 260. The payout hole 258 is designed to receive and retain a payout tube (not shown). When the carton blank is assembled, the interior front panel 250 is located directly underneath the front panel 204. A filamentary material pulled from within an assembled carton passes first through the payout tube and then the opening 220 in the front panel 204.

To prevent the pullable end of the filamentary material from slipping back into the carton during shipping, this end is pulled from the carton during assembly, through the interior front panel 250 via a payout tube inserted in payout tube opening 258, and inserted into retention hole 260. The front panel 204 is then closed over the interior front panel 250 to secure the filamentary material.

The carton blank 200 may be assembled by hand or by machine. First the carton blank 200 is folded at a 90 degree angle along the fold or score line 244, between the back panel 234 and the right panel 225. The interior upper and bottom panels 230 and 236 are then folded along fold lines 238 and 242 inward at a 90 degree angle to the back panel 234. The top panel 202 is then folded along fold line 252 over the interior upper panel 230. Similarly, the bottom panel 219 is folded along fold line 256 over the interior lower panel 236. The interior front panel 250 is folded inward at a 90 degree angle to the right side panel 225, such that the interior front panel 250, interior upper panel 230, interior bottom panel 219, the back panel 234, and right side panel 225 form an open container. An air coil of filamentary material may then be inserted into the container. A paytube is inserted through the payout tube opening 258 and through the coil of filamentary material. The pullable end of the filamentary material is removed through the payout tube and inserted into retention hole 260. The left panel 206 is folded over the opening and filamentary material. The front panel 204 is then folded over and covers the interior front panel 250. The first upper flap 208 and second upper flap 212 are folded over and adhered to the top panel 202. Likewise, the first lower flap 215 and second lower flap 217 are folded over and adhered to the bottom panel 219, thus completing assembly.

Figure 3A:
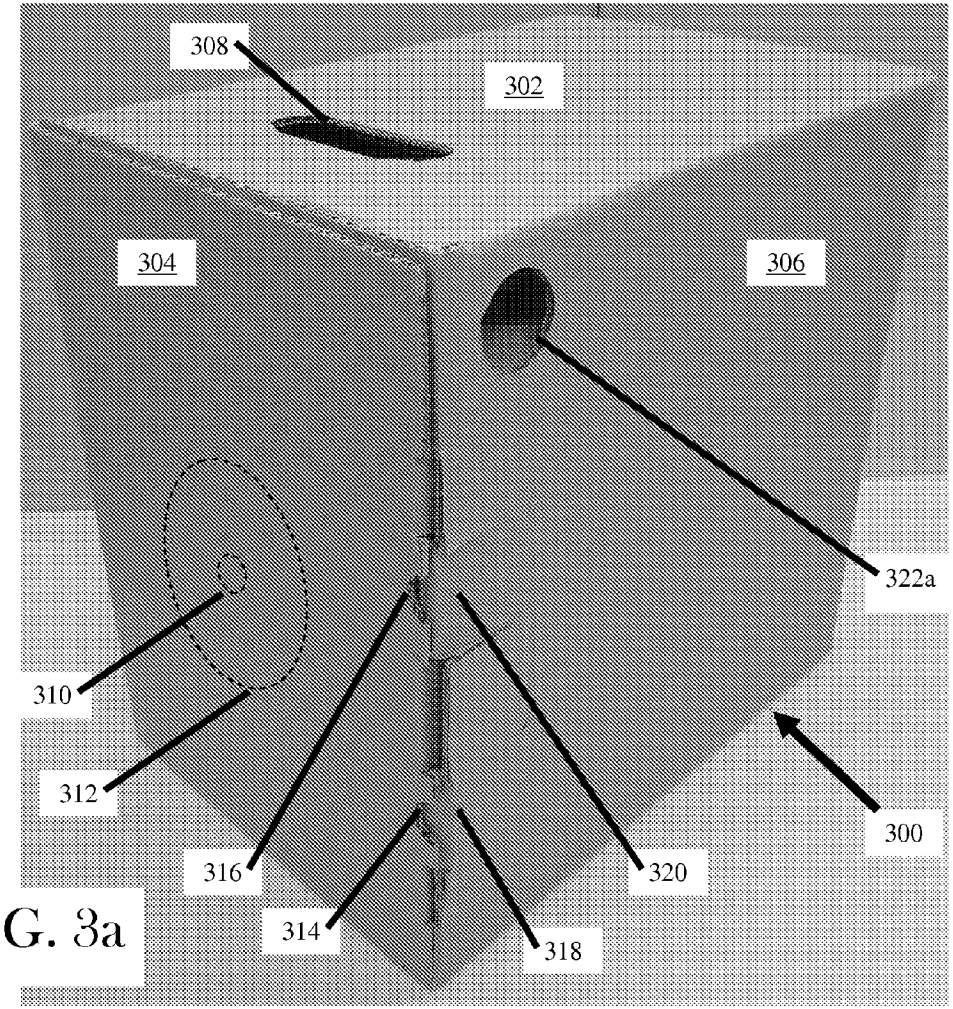
FIG. 3*a* is a right side perspective view of a third embodiment of an assembled non-reel wire carton.
Figure 3B:
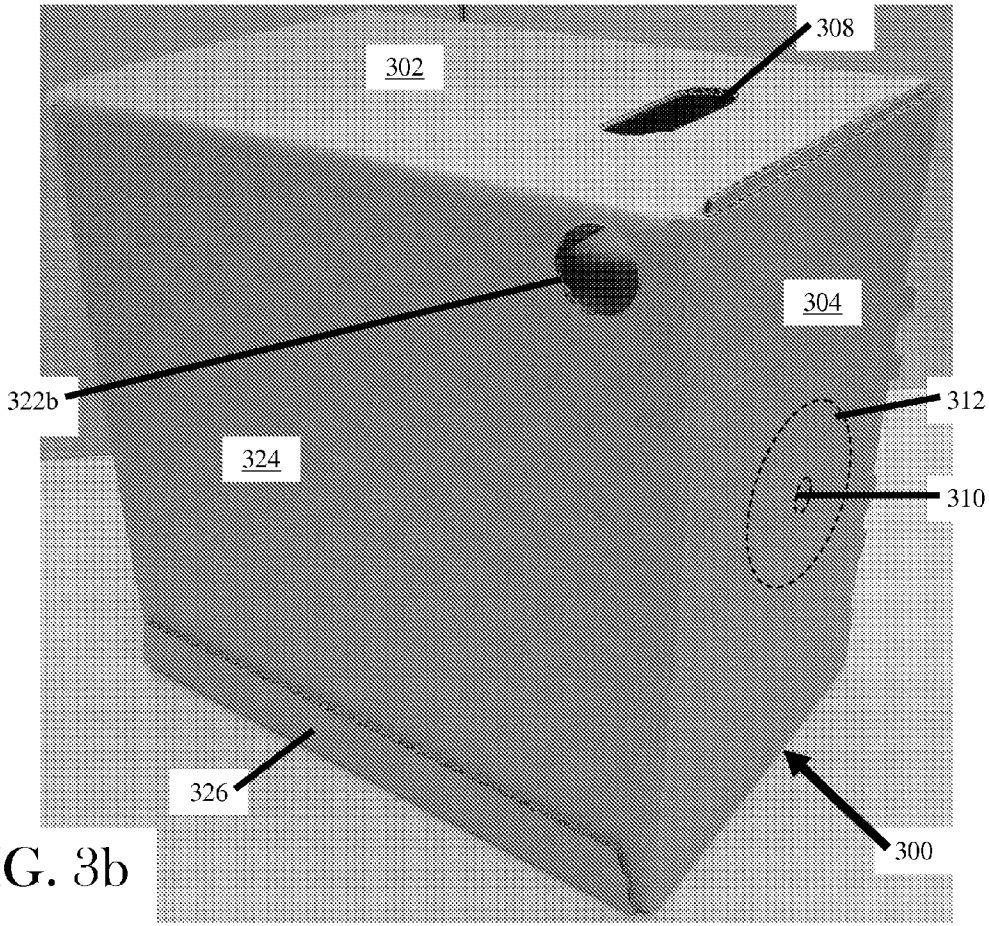
FIG. 3*b* is a left side perspective view of a third embodiment of an assembled non-reel wire carton.

Another embodiment of a non-reel carton 300 which is suspendable from a shaft is shown in FIGS. 3*a* and 3*b*. As with the previous embodiment, this embodiment includes opposed, aligned holes located on opposite sides of the carton 300. These opposed, aligned holes are located in an upper corner of opposite panels. The holes are sized to receive a shaft or rod, from which the carton 300 may be suspended.

Unlike the previous embodiment, shown, for example, in FIG. 1, the non-reel carton 300 in FIGS. 3*a* and 3*b* includes an interior channel positioned between the holes for receiving a shaft. The interior channel is formed by panels, which are hingedly attached to the carton 300. These panels are rolled or folded to form the channel, which is then inserted into the carton. The channel separates the contents of the non-reel carton 300 from a rod or shaft which is passed through the holes.

The top panel 302, a front panel 304, and right side panel 306 of an assembled non-reel carton 300 with an interior channel is shown in FIG. 3*a*. The top panel includes a handhold opening 308. The handhold opening 308 has an oblong oval shape, though any suitable shape may be used. The front panel 304 includes an inner circle 310 and outer circles 312 of perforations, defining a removable opening. The inner circle of perforations 310 defines a finger-hole, which when poked out allows the grasping of the material defined by the outer circle of perforations 312. An individual may access the contents of the carton 300 by removing the material defined by the outer circle of perforation 312. The front panel also includes separate slots 314 and 316 which run along a portion of its edge, a fold line, closest to the right side panel.

The right side panel 306 includes two right side tabs 318 and 320, which are hingedly attached to the right side panel 306 at the edge closest to the front panel 304. The tabs 318 and 320 are shown inserted into corresponding slots 314 and 316 located along the edge of the front panel 304. The front panel 304 is hingedly attached to the left side panel and closes over an opening created by the other panels to seal the contents of the carton 300. The front panel 304 has a hingedly connected tab (not shown) which is received into a slot located between the right side panel 306 and an interior panel (not shown). Access to the contents of the carton 300 may be achieved by removing the two right side tabs 318 and 320 from slots 314 and 316, folding back the front panel 304 and interior panels (not shown). To close, the front panel 304 is folded over the opening, the hingedly connected tab (not shown) are inserted into a slot located between the right side panel 306 and an interior panel (not shown), and the two right side tabs 318 and 320 are inserted into respective slots 314 and 316, thus securing the front panel 304.

A circle-shaped hole 322*a* is located along the perimeter and in the upper corner of right side panel 306 that is closest to the front panel 304. An aligned matching circle-shaped hole 322*b* is also located along the perimeter and in the upper corner of the left side panel (FIG. 3*b*). In other embodiments, the circle-shaped holes may be located in other corners or have other shapes, including being diamond shaped, circular, rectangular, etc. The circle-shaped hole 322*a* is sized to receive a shaft or rod. The circle-shaped hole 322*a* leads to a channel located within the interior of the carton 300. The channel extends between the circle-shaped hole 322*a* in the right side panel 306 and its aligned matching circle-shaped hole 322*b* in the left side panel 324.

FIG. 3*b* illustrates the left perspective view of an assembled non-reel carton with an interior channel 300, first shown in FIG. 3*a*. In FIG. 3*b*, the top panel 302, a front panel 304, and the left side panel 324 are visible. The top panel 302 includes a handhold opening 308, and the front panel 304 includes circles of inner perforation 310 and outer perforations 312, as explained above. The front panel 304 is hingedly attached to the left side panel 324.

A circle-shaped hole 322*b* is located along the perimeter and in the upper corner of left side panel 324 that is closest to the front panel 304. This circle-shaped hole 322*b* is aligned with matching circle-shaped hole 322*a* located along the perimeter and in the upper corner of the right side panel 306, as shown in FIG. 3*a*. The circle-shaped hole 322*b* is sized to receive a shaft or rod. The circle-shaped hole 322*b* leads to a channel located within the interior of the carton 300. The channel extends between the circle-shaped hole 322*b* in the left side panel 324 and its aligned matching circle-shaped hole 322*a* in the right side panel 306.

A lower flap 326 is hingedly attached to and extends from the bottom panel of non-reel carton 300. The lower flap 326 is folded over and its underside glued or otherwise adhered to the left side panel 324. In this embodiment, the underside of lower flap 326 is the only flap adhered to another panel; although, other embodiments may include additional flaps which are adhered to panels to secure or close the carton 300.

Figure 4:
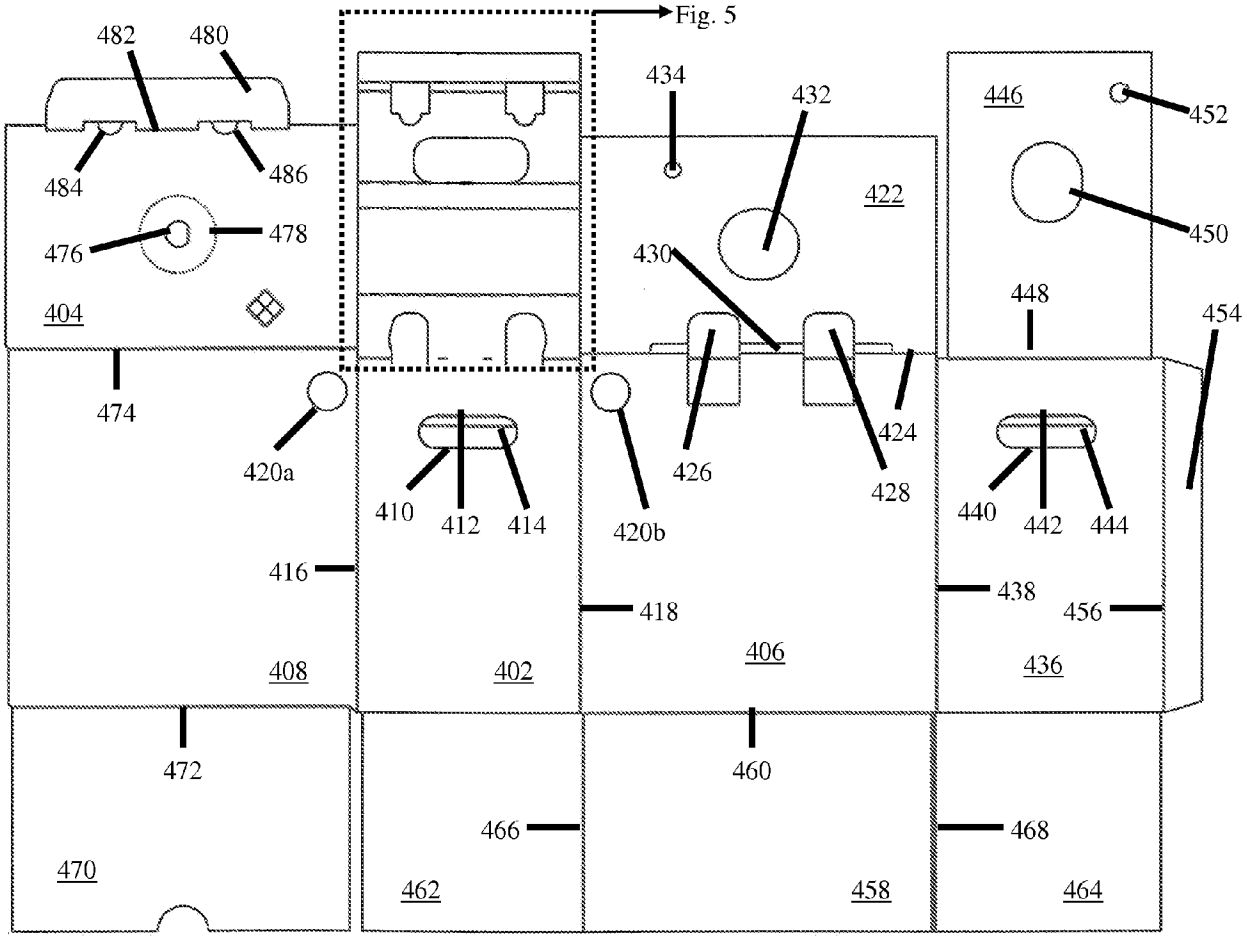
FIG. 4 is a plan view of a carton blank used to construct the embodiment shown in FIGS. 3*a* and 3*b*.

FIG. 4 illustrates an embodiment of a blank 400 for forming a non-reel carton to hold the filamentary material, corresponding to the assembled non-reel carton shown in FIGS. 3*a* and 3*b*. The blank 400 comprises a plurality of panels or walls forming an enclosed non-reel carton. Generally, the panels or walls are substantially rectangular in shape. The panels are hingedly connected to each other. If the carton blank 400 is made from cardboard, the hinges are created by scoring or compressing the boundary between the panels.

When the non-reel carton blank 400 is assembled, the resulting carton, such as the ones shown in FIGS. 3*a* and 3*b*, is suspendable from a shaft. The non-reel carton blank 400 in FIG. 4 includes several panels which, when the carton is assembled, form an interior channel. The interior channel is positioned between holes located in the left and right panels. The panels, which form the channel, are hingedly attached to the carton blank 400. These panels are rolled or folded to form the channel, which is then inserted into the carton.

The blank 400 includes a top panel 402, a front panel 404, right side panel 406, and a left side panel 408, which corresponded to the top panel 302, front panel 304, right side panel 306, and left side panel 324 shown in FIGS. 3*a* and 3*b*. The top 402 panel has a first handhold defined by perforations 410 on three sides of an oblong oval-shape. The fourth side, a long side oblong oval-shape of the handhold, is a first fold line 412. A second fold line 414 is located within the material defined by perforations. Once the perforations 410 are broken, the first and second fold lines 412 and 414 permit the material defined by the perforations 410 to be folded within the assembled carton to create the handhold.

The top panel 402 of the carton blank 400 is hingedly connected to a right side panel 406 and a left side panel 408 by fold lines 418 and 416, respectively. The left side panel 408 and right side panel 406 include circle-shaped holes 420*a* and 420*b* or perforations or cutouts for creating the circle-shaped holes 420*a* and 420*b*. The circle-shaped holes 420*a* and 420*b* on the blank 400 correspond with the holes 322*a* and 322*b* shown in FIGS. 3*a* and 3*b*. The circle-shaped, exterior holes 420*a* and 420*b* are located along the perimeter of the left side panel 408 and right side panel 406 in the upper corner closest to the top panel and are substantially in alignment. In alternative embodiments, the holes 420*a* and 420*b* may be located in any corner, along the perimeter of the panels, so long as the location of hole 420*a* on the left panel 408 mirrors the position of the hole 420*b* on the right side panel 406, such that when the non-reel carton is assembled from the blank 400, holes 420*a* and 420*b* are in substantial alignment, such that a shaft may pass through the holes 420*a* and 420*b* and that the assembled carton may hang from the shaft. As shown in FIG. 4, the holes 420*a* and 420*b* are circle-shaped; although, they may have other shapes, such as ovals, diamonds, rectangles, etc.

The right side panel 406 is hingedly attached to a first interior front panel 422 by fold line 424. Hingedly attached to the right side panel are tabs 426 and 428. The tabs are cut out of the first interior front panel 422 and are connected by fold lines. Tabs 426 and 428 correspond to tabs 318 and 320 shown in FIG. 3*a*. A slot 430 for receiving a tab connected to the front panel 404 is located along the fold line 424 between the first interior front panel 422 and the right side panel 406. The first interior front panel also includes a hole 432 for receiving a payout tube and a retention hole 434.

The right side panel 406 is hingedly attached to the bottom panel 436 by fold line 438. The bottom panel 436 has a second handhold defined by perforations 440 on three sides of an oblong oval-shape. The fourth side, a long side oblong oval-shape of the second handhold, is a first fold line 442. A second fold line 444 is located within the material defined by the perforations 440. Once the perforations 440 are broken, the first and second fold lines 442 and 444 permit the material defined by the perforations 440 to be folded within the assembled carton to create the handhold.

The bottom panel 436 is hingedly attached to the second interior front panel 446 by fold line 448. The second interior panel also includes a hole 450 for receiving a payout tube and a retention hole 452.

The bottom panel 436 is also hingedly attached to a lower flap 454 by fold line 456. The lower flap 454 corresponds to the lower flap 326 shown in FIG. 3*b*. Prior to assembly of the blank 400, the lower flap 454 is folded over the left side panel 324 and the underside of the lower flap 454 is glued or otherwise adhered.

The right side panel 406 is hingedly attached to the back panel 458 by fold line 460. The back panel 458 is hingedly attached to an interior top panel 462 and an interior bottom panel 464 by fold lines 466 and 468, respectively.

The left side panel 408 is hingedly attached to a second interior back panel 470 by fold line 472 and hingedly attached to front panel 404 by fold line 474. The front panel 404 includes inner and outer circles 476, 478 of perforations, defining a removable opening. The inner circle of perforations 476 defines a finger-hole, which when poked out allows the grasping of the material defined by the outer circle of perforations 478. An individual may access the contents of the carton assembled from the carton blank 400 by removing the material defined by the outer circle of perforation 478.

A front tab 480 is hingedly attached to the front panel 404 by fold line 484. Two separated front panel slots 484 and 486 are located along the fold line between the front tab 480 and the front panel 404. Two separated slots 484 and 486 correspond to the separate slots 314 and 316 shown in FIG. 3*a*. The final steps in assembly of the carton blank 400 include inserting the front tab 480 into mating slot 430 and inserting tabs 426 and 428 into front panel slots 484 and 486.

Figure 5:
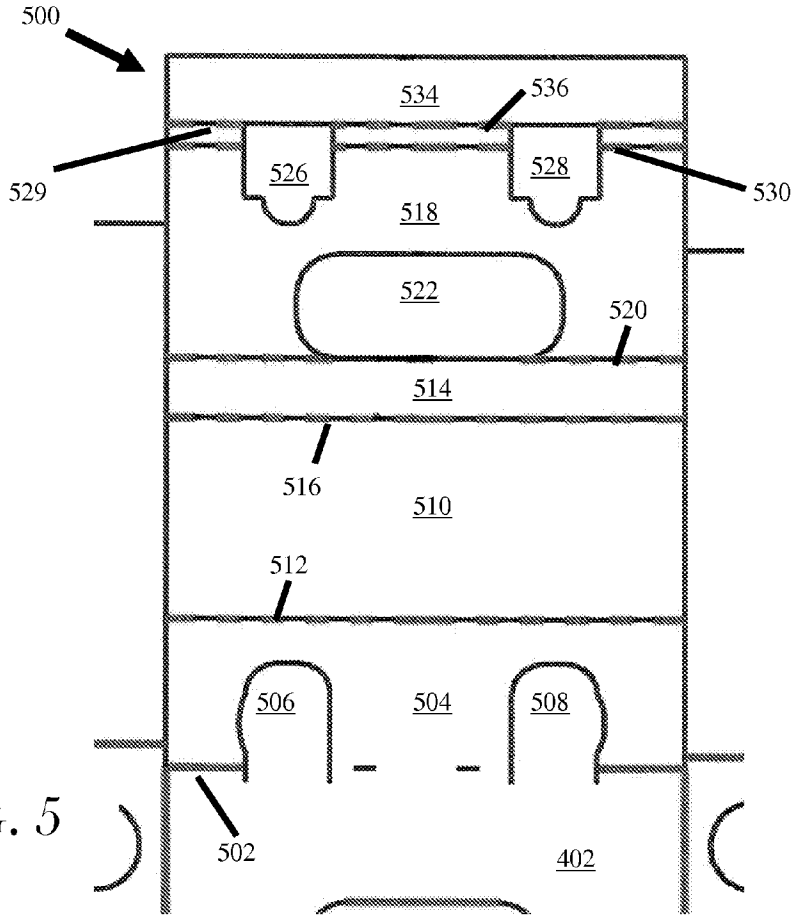
FIG. 5 is an enlarged plan view of the portion of the carton blank encompassed by the dotted rectangle in FIG. 4, showing the panels which form the interior channel.

FIG. 5 shows a partial enlarged view of the series of six panels 500 that form the interior channel. The six panels 500 are approximately the same width as the top panel 402; although, in other embodiments the series of panels 500 may have varying sizes or be smaller in size than the top panel 402. The series panels 500 are hingedly connected at one end to the top panel 402 of the carton blank 400 by fold line 502. In other words, the carton blank and the panels 500 which form the interior channel in this embodiment are connected and unitary. In other embodiments, the panels 500 may be removably attached, removably and hingedly attached, or connected to the carton blank 400 or assembled carton by other means, such as adhering, gluing or mechanically fastening.

A fold line 502 is located between first panel 504 of the series of panels 500 and the top panel 402. Two securing tabs 506 and 508 are cut out of the first panel 504. The two securing tabs 506 and 508 are hingedly connected to the top panel 402.

A second panel 510 is hingedly connected to the first panel 504 by fold line 512. Likewise, the second panel is hingedly connected to the third panel 514 by fold line 516. The third panel is hingedly attached to the fourth panel 518 by fold line 520. The fourth panel 518 includes a cutout for a handhold opening 522. The fourth panel 518 and the fifth panel 529 have cutouts which form large slots 526 and 528. The large slots 526 and 528 respectively receive securing tabs 506 and 508 during assembly. The fourth panel 518 of the series is hingedly attached by fold line 530 to fifth panel 529. The sixth and final panel 534 of the series of panels that form the interior channel is hingedly attached by fold line 536 to the fifth panel 529.

The carton blank 400 shown in FIGS. 4 and 5 may be assembled by hand or by machine. Prior to assembly, the carton blank 400 is folded in half at or along the fold/score line 418 between the top panel 402 and the right side panel 406. That is, the top panel 402 and the left side panel 408 are folded 180° about fold line 418 so they lie virtually flat on right side panel 406 and back panel 436. In this condition the connecting flap 454 is folded at fold line 456 such that the flap 454 overlays the edge of the left side panel 408, and the underside of flap 454 is glued or otherwise adhered or secured to the left side panel 408. As a result, the carton blank 400 is flat and may be shipped or stored prior to assembly. To assemble, the carton blank is set up by folding at fold lines 416, 418, 438 and 456, such that the top panel 402 and bottom panel 436 oppose each other and the right side panel 406 and left panel 408 oppose each other, forming an open, interior space between these four panels.

The second interior back panel 470 is then folded along fold line 472 and placed within the interior space and temporarily against the underside of the left side panel 408. The interior top panel 462 and interior bottom panel 464 are folded along fold lines 466 and 468, respectively, inwards, toward each other and the interior open space until they lay against the back panel 458. The back panel is then folded together with the interior top panel 462 and interior bottom panel 464 along fold line 460 to close one end of the interior space formed by the top panel 402, right side panel 406, left side panel 408 and bottom panel 436. Next, the interior top panel 462 is folded along fold line 466 such that it resides flush against the top panel 402, and the interior bottom panel 464 is folded along fold lines 468 to reside flush against the bottom panel 436. Thereafter, the interior back panel 470 is folded back along fold line 472 such that it resides flush against the back panel 458. At this point the partially assembled carton may receive a non-reel coil of filamentary material, such as electrical wire, within the interior space formed by the top panel 402, right side panel 406, left side panel 408, bottom panel 436, back panel 458, and the associated interior panels. The filamentary material is inserted through the open front end of the interior space. Afterwards, the interior channel is assembled and inserted into the interior space.

Figure 6A:
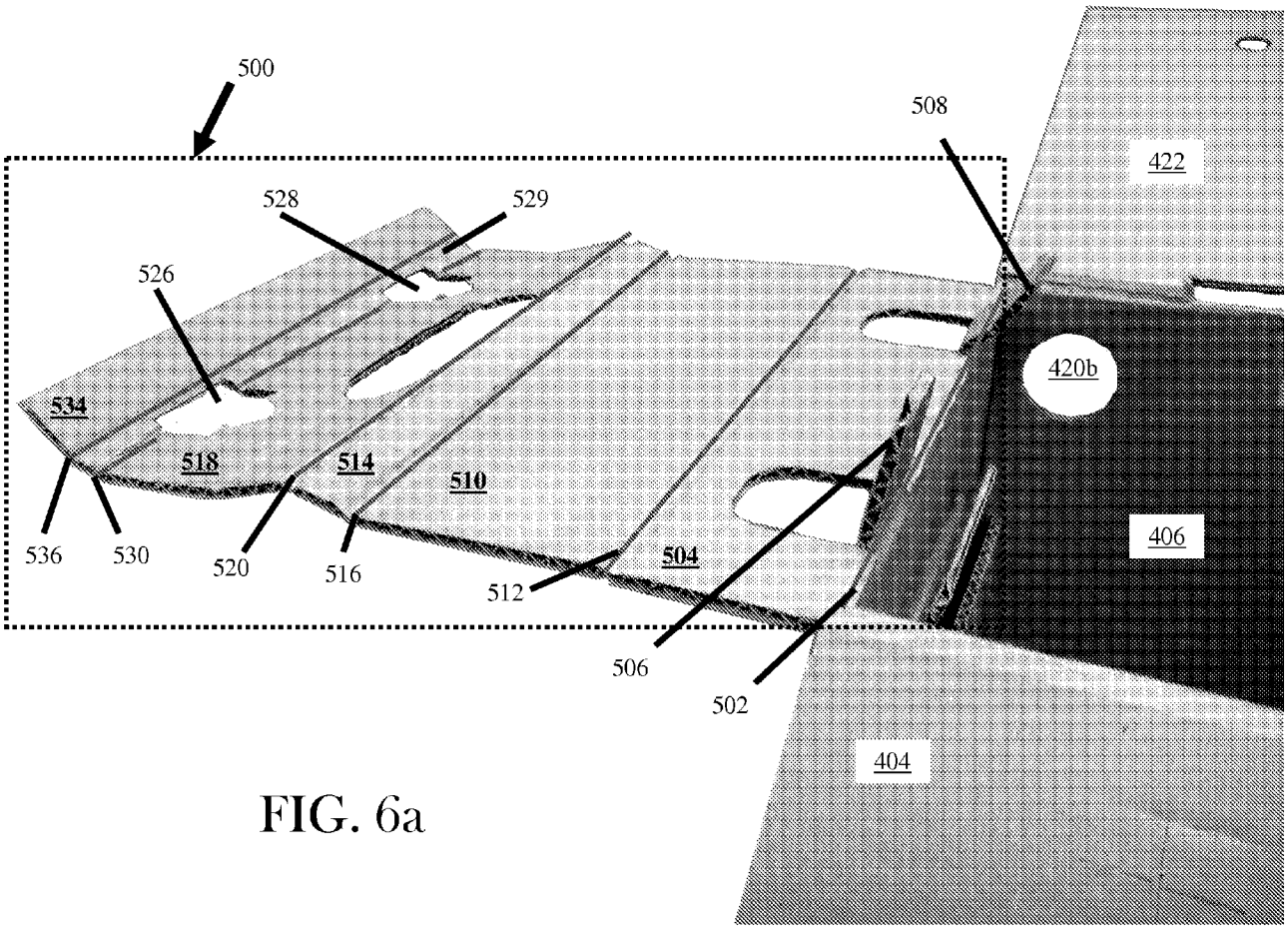
FIGS. 6*a-e* are perspective views detailing the steps of how to assemble the panels shown in FIG. 5 into the interior channel.
Figure 6B:
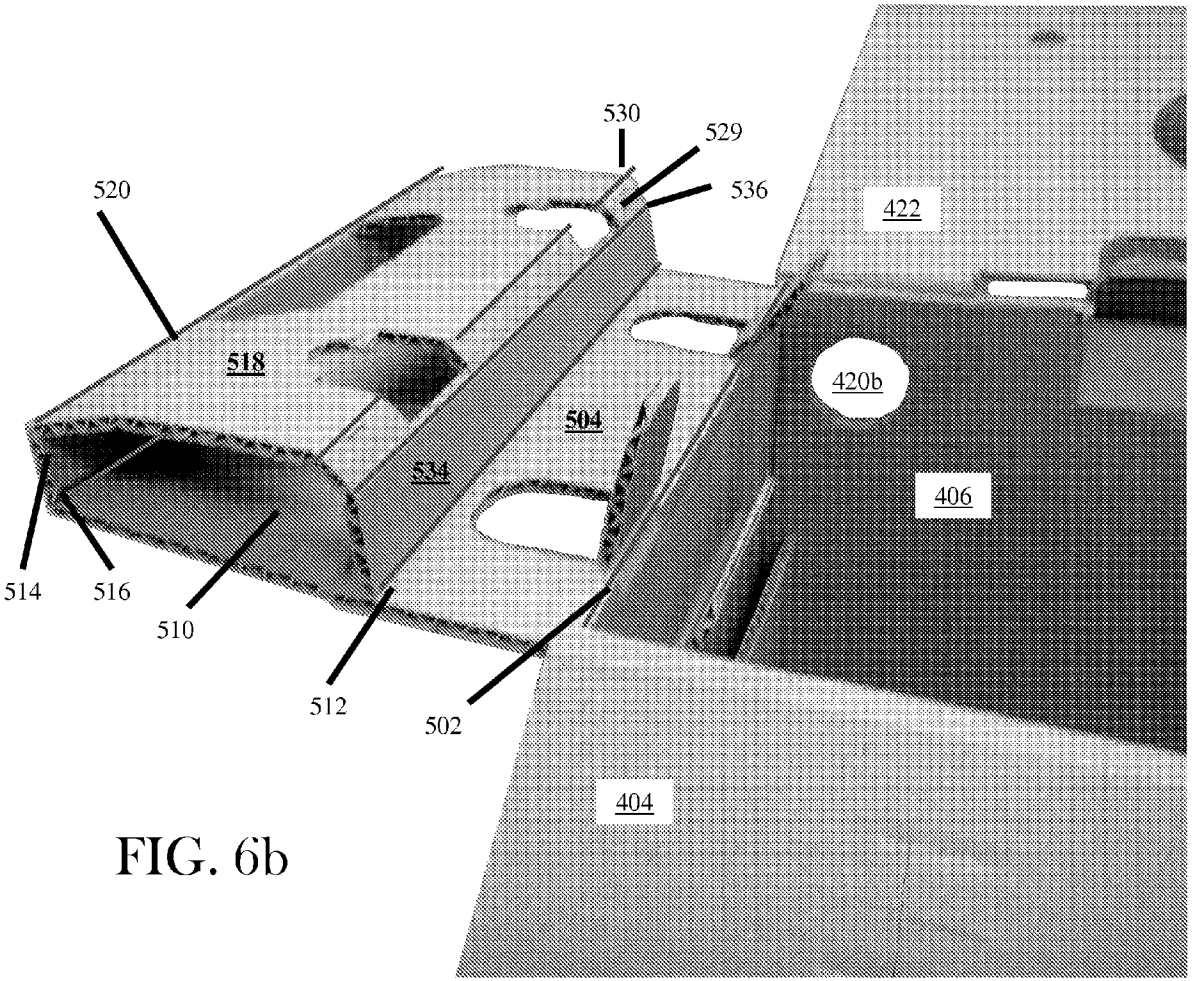

The interior channel is formed by folding or rolling up the six panels 500, shown in FIG. 5, to form the channel therein. Each panel is folded along the respective fold lines toward the interior space of the carton. As shown in FIG. 6*a*, initially, the panels 500 are hingedly attached and extend from the partially assembled carton at fold line 502. At this point in the assembly process, the front panel 404 and the first interior front panel 422 are open, allowing access to the interior space of the carton and any material located inside. FIG. 6*b* illustrates how the panels 500 are folded along fold lines 516, 520, 530, and 536 such that the sixth panel 534 is rolled over the second panel 510 and the outside edge of the sixth panel 534 touches the fold line 512. The interior channel is defined by the second panel 510, third panel 514, fourth panel 518, fifth panel 529, and sixth panel 534.

Figure 6C:
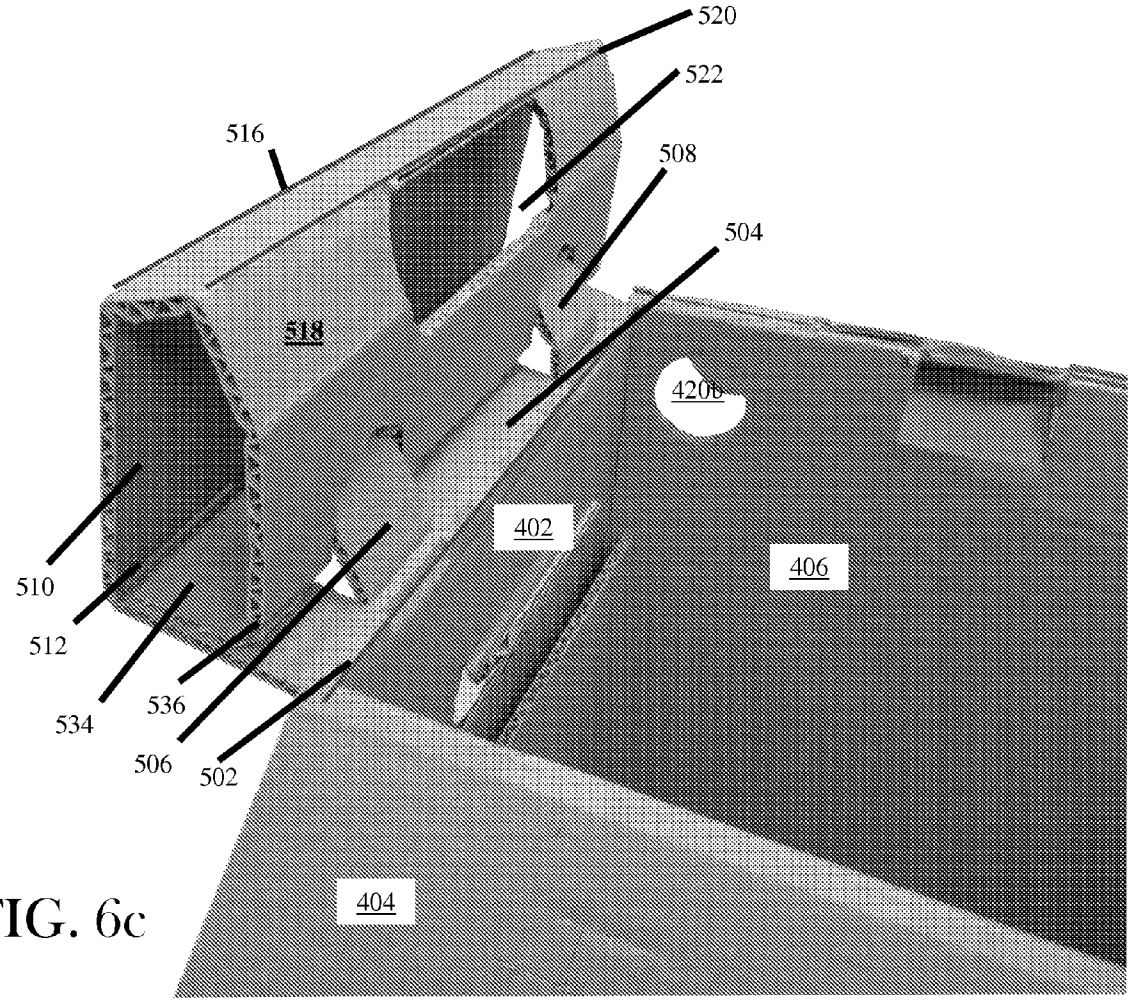

FIG. 6*c* illustrates the next steps of folding the interior channel along the fold line 512 such that the sixth panel 534 is located flush against the first panel 504. At this stage tabs 506 and 508 are inserted into slot 526 and 528, respectively. The tabs 506 and 508 secure the panels 500 for the interior channel, such that the panels do not unroll.

Figure 6D:
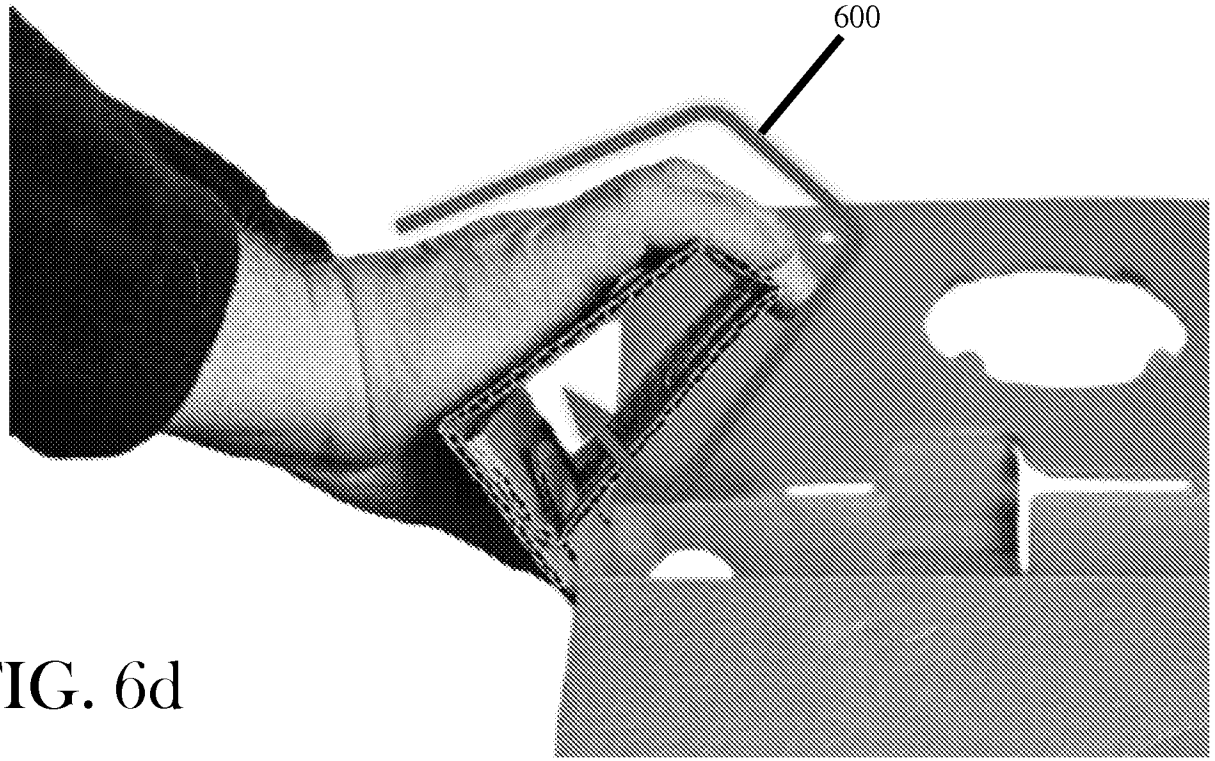

FIG. 6*d* illustrates the motion of folding up the six panels to form the interior channel if performed manually. The panels are rolled up in the direction of the arrow 600. It is contemplated that the assembly of the carton and folding or rolling function shown in FIG. 6*d* may be automated by a machine.

Figure 6E:
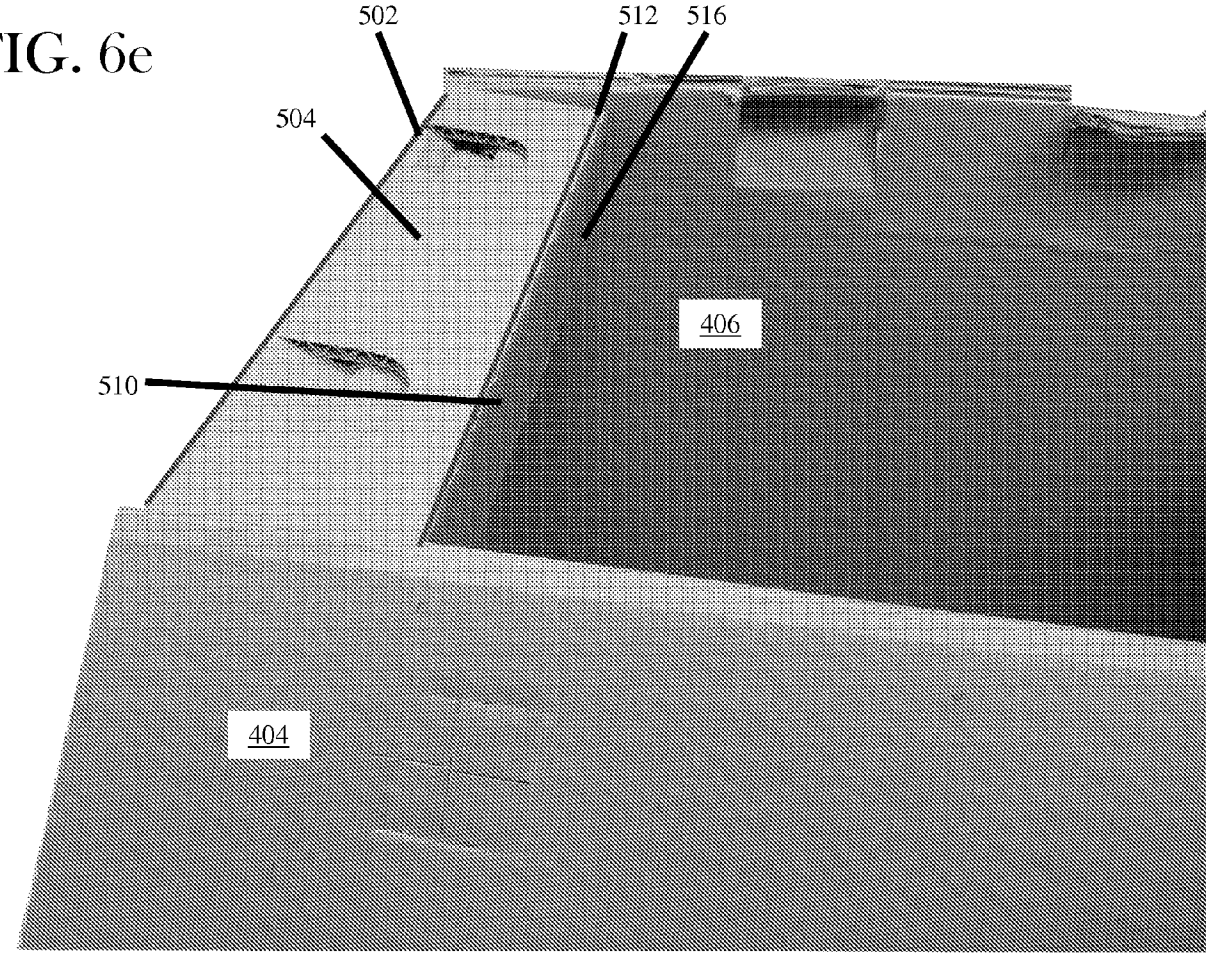

The final step in construction of the interior channel is inserting the channel into the interior space by folding along the fold line 502 located between the top panel 402 and the first panel 504, as shown in FIG. 6*e*. As shown, the first panel 504, second panel 510, and the other panels (hidden from view) are located within the interior space of the carton and in an upper corner of the carton. The panels which form the interior channel, such as first panel 504 and second panel 510, fit tightly between the right side panel 406 and the left side panel (not shown) and between the two exterior holes in the right side panel and the left side panel (i.e. circle-shaped, exterior holes 322*a* and 322*b*, shown in FIGS. 3*a* and 3*b*, or circle-shaped, exterior holes 420*a* and 420*b* shown in FIG. 4). As a result, the interior channel is in alignment with the two exterior holes such that a shaft or rod may pass through an exterior hole, continue through the interior channel, and exit through the other exterior hole.

The panels which form the interior channel reinforce the right side and left side panels against compressive forces. When the channel is assembled, the fourth panel 518 forms the top of the channel and, after the panels 500 are inserted into the carton, the fourth panel 518 lays flush along the underside of the top panel 402. The fourth panel 518 reinforces the top panel 402 and helps distribute the forces resulting from hanging the completed carton on a shaft or rod. When panels 500 are inserted into the carton, a handhold opening 522 located in the fourth panel 518, as shown in FIG. 5, aligns with the handhold opening 410 in top panel 402. The fourth panel 518 helps to reinforce the handhold opening, allowing an individual to grip and carry the carton without the handhold or top panel tearing.

To complete construction of the carton, the first front interior panel 422 and second interior panel 446 are folded along fold lines 424 and 448, respectively, to cover the interior space. In doing so the payout tube hole 432 in the first interior front panel 422 aligns with the second payout tube hole 450 in the second interior front panel 446. A payout tube may be inserted through both payout tube holes 432 and 450 and into the filamentary material within the interior space of the carton. An end of the filamentary material may be brought up through the payout tube and retained in retaining holes 434 and 452, which also align.

Next, the front panel is folded along fold line 474 over the interior front panels 422 and 446. The front panel tab 480 is inserted into the receiving slot 430 located between the right side panel 406 and the first interior front panel 422. Finally, securing tabs 426 and 428 are inserted into the respective slots 484 and 486 located between the front panel 404 and the tab 480. The fully assembled carton is then ready to ship or utilize.

While the embodiments have been described with reference to certain illustrative aspects, it will be understood that this description shall not be construed in a limiting sense. Rather, various changes and modifications can be made to the illustrative embodiments without departing from their true spirit, central characteristics and scope including those combinations of features that are individually disclosed or claimed herein. For example, the size, shape and number of the panels, walls, and apertures may be adjusted to accommodate different sizes of filamentary material or articles other than filamentary wire. Additionally, the panels that form the interior channel may be connected in a different manner or in different locations. The panels that form the interior channel may be connected to or used in association with entirely different carton blank configurations from those described above. Another alternate form might include additional panels that form a second interior channel. Two pairs of exterior aligned holes may be located in the left and right side panels, permitting the carton to hang from a pair of shafts. An interior channel may be located between each pair of exterior aligned holes. The panels forming the first and second interior channels may be separate, such that the interior channels are separate and separately located. For example, at least one of the panels forming the first interior channel is hingedly connected to the top panel of the carton blank, while at least one of the panels forming the second interior channel is hingedly connected to the bottom panel of the carton blank. In the alternative, the panels forming the first and second interior channels connected together in a unitary manner. Furthermore, it will be appreciated that any such changes and modifications will be recognized by those skilled in the art as an equivalent to one or more elements of the following claims, and shall be covered by such claims to the fullest extent permitted by law.

I claim:

1. A carton blank, comprising:

a front panel, the front panel hingedly connected to a left side panel;

the left side panel hingedly connected to a top panel;

the top panel hingedly connected to a right side panel and hingedly connected to one or more panels for forming an interior channel;

the right side panel hingedly connected to a bottom panel and hingedly connected to a back panel; and wherein the left side panel includes a first hole located in along the perimeter of the left side panel and the right side panel includes a second hole located along the perimeter of the right side panel and the first and second holes are located in substantial alignment.

2. The carton blank of claim 1, wherein, the right side panel or the bottom panel is hingedly connected to an interior front panel, the interior front panel having a cutout for receiving a payout tube.

3. The carton blank of claim 1, wherein, the first hole is located in a corner of the left side panel and the second hole is located in a corner of the right side panel.

4. The carton blank of claim 1, wherein, the top panel has perforations or a cutout defining a handhold.

5. A non-reel carton for dispensing filamentary material, comprising:

a carton, having a plurality of panels that define an interior of the carton;

a pair of aligned, exterior holes, each hole being located in a panel that defines the interior of the carton;

a plurality of panels that form an interior channel, at least one of said panels that forms an interior channel being hingedly connected to one of the said panels that defines the interior of the carton, the interior channel being located within the interior of the carton and between the pair of aligned, exterior holes, whereby a shaft may be inserted from the exterior of the carton, through one of the pair of aligned exterior holes, continues through the interior channel, and exits the carton through the other of the pair of aligned exterior holes.

6. The non-reel carton for dispensing filamentary material in claim 5, wherein the interior channel is located in a corner of the carton.

7. The article for dispensing filamentary material in claim 5, wherein the holes are circle-shaped.

8. The non-reel carton for dispensing filamentary material in claim 5, wherein the plurality of panels that define an interior of the carton are cardboard.

9. The carton blank of claim 5, wherein, one of said panels that defines an interior of the carton has perforations or a cutout defining a handhold and one of said panels that defines an interior channel having a cutout defining a handhold.

* * * * *